US011259114B2

(12) United States Patent
Kelly et al.

(10) Patent No.: US 11,259,114 B2
(45) Date of Patent: Feb. 22, 2022

(54) LOUDSPEAKER AND SOUND OUTPUTTING APPARATUS HAVING THE SAME

(71) Applicant: SAMSUNG ELECTRONICS CO., LTD., Suwon-si (KR)

(72) Inventors: Liam Kelly, Suwon-si (KR); Yoonjae Lee, Suwon-si (KR); Haekwang Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/080,279

(22) Filed: Oct. 26, 2020

(65) Prior Publication Data

US 2021/0136488 A1 May 6, 2021

(30) Foreign Application Priority Data

Nov. 6, 2019 (KR) ..... 10-2019-0140619

(51) Int. Cl.
*H04R 1/34* (2006.01)
*H04R 1/02* (2006.01)

(52) U.S. Cl.
CPC ..... *H04R 1/345* (2013.01); *H04R 1/025* (2013.01)

(58) Field of Classification Search
CPC ..... H04R 1/345; H04R 1/025
USPC ..... 381/338
See application file for complete search history.

(56) References Cited

U.S. PATENT DOCUMENTS 3,174,578 A 3/1965 Kojima
5,115,883 A 5/1992 Morikawa et al.
5,552,569 A * 9/1996 Sapkowski ..... H04R 1/2865 181/151
8,351,639 B2 1/2013 Chang
8,855,340 B2 10/2014 Yoo et al.
9,154,879 B2 10/2015 Yoo et al.
10,667,043 B2 5/2020 Kelly et al.
11,051,103 B2 6/2021 Jung et al.
2009/0274329 A1* 11/2009 Ickler ..... G10K 11/26 381/338
2012/0070021 A1 3/2012 Yoo et al.
(Continued)

FOREIGN PATENT DOCUMENTS

GB 2535790 A 8/2016
JP 11168681 A 6/1999
(Continued)

OTHER PUBLICATIONS

Communication dated Mar. 9, 2021, from the European Patent Office in European Application No. 20202916.1.
(Continued)

*Primary Examiner* — Sean H Nguyen
(74) *Attorney, Agent, or Firm* — Sughrue Mion, PLLC

(57) ABSTRACT

A sound outputting apparatus is provided. The sound outputting apparatus includes: a main body; and a loudspeaker accommodated in the main body. The loudspeaker includes: a vibration member configured to generate sound waves; and a sound guide having a first end connected to the vibration member, a second end having an open structure, a first surface between the first end and the second end, and a plurality of openings formed through the first surface along a longitudinal direction of the sound guide. The plurality of openings increase in size as distance from the vibration member increases.

21 Claims, 12 Drawing Sheets

(56) References Cited

U.S. PATENT DOCUMENTS

| | | | | |
|---|---|---|---|---|
| 2013/0322666 | A1 | 12/2013 | Yoo et al. | |
| 2018/0167724 | A1* | 6/2018 | Jung | H04R 1/345 |
| 2018/0242077 | A1 | 8/2018 | Smithers et al. | |
| 2019/0069089 | A1 | 2/2019 | Jung et al. | |
| 2019/0166419 | A1 | 5/2019 | Ko et al. | |
| 2019/0166421 | A1* | 5/2019 | Kelly | H04R 1/2811 |
| 2020/0252717 | A1 | 8/2020 | Kelly et al. | |

FOREIGN PATENT DOCUMENTS

| | | | |
|---|---|---|---|
| JP | 2009-296153 | A | 12/2009 |
| JP | 2017228879 | A | 12/2017 |
| KR | 10-2010-0137682 | A | 12/2010 |
| KR | 10-1268779 | B1 | 5/2013 |
| KR | 10-2013-0134815 | A | 12/2013 |
| KR | 10-2019-0021602 | A | 3/2019 |
| KR | 10-2019-0062144 | A | 6/2019 |
| WO | 2016/110876 | A1 | 7/2016 |

OTHER PUBLICATIONS

International Search Report (PCT/ISA/210) issued by the International Searching Authority in International Application No. PCT/KR2020/014668, dated Feb. 15, 2021.

Written Opinion (PCT/ISA/237) issued by the International Searching Authority in International Application No. PCT/KR2020/014668, dated Feb. 15, 2021.

* cited by examiner

LOUDSPEAKER AND SOUND OUTPUTTING APPARATUS HAVING THE SAME

CROSS-REFERENCE TO RELATED APPLICATION(S)

This application is based on and claims priority under 35 U.S.C. § 119 to Korean Patent Application No. 10-2019-0140619, filed on Nov. 6, 2019, in the Korean Intellectual Property Office, the disclosure of which is incorporated by reference herein in its entirety.

BACKGROUND

Field

The disclosure relates to a loudspeaker with increased directivity and a sound outputting apparatus having the same.

Description of Related Art

A loudspeaker is an apparatus that generates sound waves by vibrating according to an electrical signal transmitted from a television, a radio or the like. The loudspeaker may be classified into an omni-directional loudspeaker generating sound waves to emit sounds of the same energy in all directions with no sound emitted in a specific direction, and a highly-directional speaker generating sound waves to emit sounds of high energy in the specific direction.

In recent years, a miniaturized and integrated home audio system, such as a wireless speaker and a sound bar, has become increasingly popular. For a user to experience sound in a wide sound stage from this miniaturized and integrated speaker, a highly-directional speaker may expand a sound field through sound waves reflected from surrounding walls.

The sound waves emitted toward the interior wall surface may be reflected by the wall and reach the user, and the user may thus have an auditory illusion as the sound waves come from his/her side. However, additional speakers or sound structures may be needed to expand the sound field, and thus require additional cost or space.

SUMMARY

Embodiments of the disclosure overcome the above disadvantages and other disadvantages not described above. In addition, the disclosure is not required to overcome the disadvantages described above, and an embodiment of the disclosure may not overcome any of the problems described above.

One or more embodiments provide a loudspeaker with an enhanced sound field or spatial image using a plurality of openings and a sound outputting apparatus having the same.

In accordance with an aspect of the disclosure, a loudspeaker includes: a vibration member configured to generate sound waves; and a sound guide having a first end connected to the vibration member, a second end having an open structure, a first surface between the first end and the second end, and a plurality of openings formed through the first surface along a longitudinal direction of the sound guide. The plurality of openings increase in size as distance from the vibration member increases.

A cross-section of the sound guide may have one from among a circular shape, an elliptical shape and a polygonal shape.

A cross-sectional area of the sound guide may increase as distance from the vibration member increases along the longitudinal direction.

Size of the plurality of openings may increase based on a non-linear ratio as distance from the vibration member increases along the longitudinal direction.

The plurality of openings may include: a plurality of first openings that increase in size based on a predetermined ratio as distance from the vibration member increases along the longitudinal direction; and a plurality of second openings arranged subsequently to the plurality of first openings and a size corresponding to one of the plurality of first openings.

The plurality of openings may be arranged in each of a plurality of rows along the longitudinal direction.

The plurality of openings may each have one from among a circular shape, an elliptical shape, a rectangular shape, a square shape and a rhombus shape.

The plurality of openings may be spaced apart from each other by a predetermined interval.

An interval between the plurality of openings may decrease as distance from the vibration member increases.

The sound guide may further include a second surface between the first end and the second end that faces the first surface, and the second surface may curve away from the first surface as distance from the vibration member increases.

In accordance with an aspect of the disclosure, a sound outputting apparatus includes: a main body; and a loudspeaker accommodated in the main body. The loudspeaker includes: a vibration member configured to generate sound waves; and a sound guide having a first end connected to the vibration member, a second end having an open structure, a first surface between the first end and the second end, and a plurality of openings formed through the first surface along a longitudinal direction of the sound guide. The plurality of openings increase in size as distance from the vibration member increases.

A cross-section of the sound guide may have one from among a circular shape, an elliptical shape and a polygonal shape.

A cross-sectional area of the sound guide may increase as distance from the vibration member increases along the longitudinal direction.

Size of the plurality of openings may increase based on a non-linear ratio as distance from the vibration member increases along the longitudinal direction.

The plurality of openings may include: a plurality of first openings that increase in size based on a predetermined ratio as distance from the vibration member increases along the longitudinal direction; and a plurality of second openings arranged subsequently to the plurality of first openings and a size corresponding to one of the plurality of first openings.

The plurality of openings may be arranged in each of a plurality of rows along the longitudinal direction.

The plurality of openings may each have one from among a circular shape, an elliptical shape, a rectangular shape, a square shape and a rhombus shape.

The plurality of openings may be spaced apart from each other by a predetermined interval.

An interval between the plurality of openings may decrease as distance from the vibration member increases.

The main body may have a bar shape, and the loudspeaker may be accommodated in a first end of the main body and another loudspeaker may be accommodated in a second end of the main body.

In accordance with an aspect of the disclosure a loudspeaker includes: a vibration member configured to generate sound waves; and a sound guide having a first end connected to the vibration member, a second end having an open structure, a first surface between the first end and the second end, and a first opening formed through the first surface along a longitudinal direction of the sound guide. A width of the first opening increases as distance from the vibration member increases.

In accordance with an aspect of the disclosure, a loudspeaker includes a sound guide having a first end, a second end having an open structure, a first surface between the first end and the second end, and a plurality of openings formed through the first surface along a longitudinal direction of the sound guide. The plurality of openings increase in size as distance from the first end increases.

Additional and/or other aspects and advantages of the disclosure are set forth in part in the description which follows and, in part, are obvious from the description, or may be learned by practice of the disclosure.

BRIEF DESCRIPTION OF THE DRAWINGS

The above and/or other aspects, features and advantages of certain embodiments of the disclosure will be more apparent from the following description taken in conjunction with the accompanying drawings, in which.

DETAILED DESCRIPTION

To sufficiently understood configurations and effects of the disclosure, embodiments of the disclosure are described with reference to the accompanying drawings. However, the disclosure is not limited to embodiments described below, but may be implemented in several forms and may be variously modified. The description is provided only to make the disclosure complete and allow those skilled in the art to which the disclosure pertains to completely recognize the scope of the disclosure. In the accompanying drawings, sizes of components may be enlarged as compared with actual sizes for convenience of explanation, and ratios of the respective components may be exaggerated or reduced.

It is to be understood that when one component is referred to as being "on" or "in contact with" another component, it may be in direct contact with or be connected to the another component, or be in contact with or be connected to the another component with other component interposed therebetween. To the contrary, if one component is described as being "directly on" or "in direct contact with" another component, it is to be understood that there is no other component interposed therebetween. Other expressions that describe the relationship between the components, for example, "between" and "directly between" may be interpreted in the same way.

As used herein, terms the terms "1st" or "first" and "second" or "2nd" may use corresponding components regardless of importance or order and are used to distinguish one component from another without limiting the components. For example, a "first" component may be named a "second" component and the "second" component may also be similarly named the "first" component, without departing from the scope of the disclosure.

Singular forms are intended to include plural forms unless the context clearly indicates otherwise. It is to be understood that the terms "include", "have" or the like, specify the presence of features, numerals, steps, operations, components, parts or a combination thereof mentioned in the specification, but do not preclude the addition of one or more other features, numerals, steps, operations, components, parts or a combination thereof.

Terms used herein may be interpreted as generally known to those skilled in the art unless defined otherwise.

Figure 1:
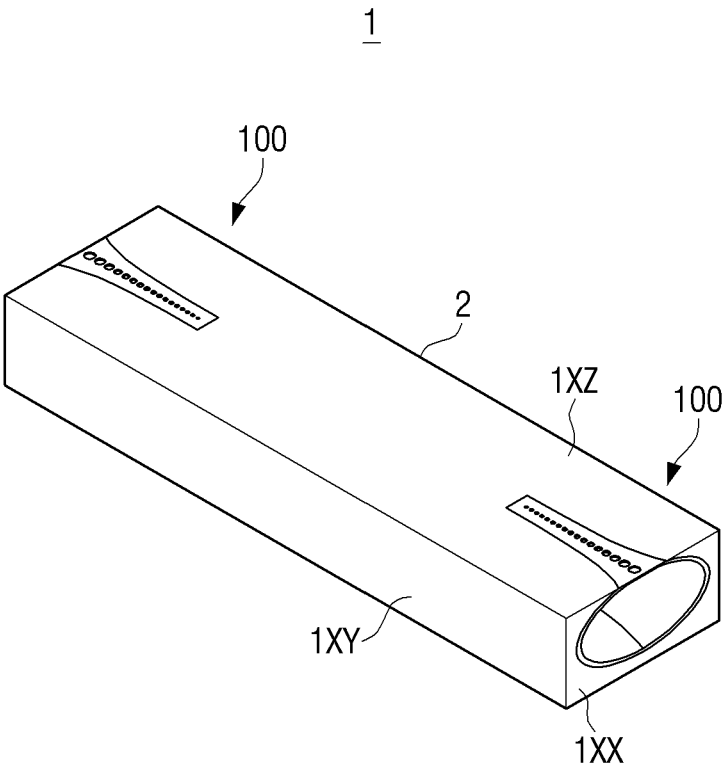
FIG. 1 is a perspective view of a sound outputting apparatus according to an embodiment.

FIG. 1 is a perspective view of a sound outputting apparatus 1 according to an embodiment.

Hereinafter, the description describes a structure of a loudspeaker and a sound outputting apparatus including a plurality of loudspeakers according to an embodiment in detail with reference to the drawings.

The sound outputting apparatus 1 may include a main body 2 and a plurality of loudspeakers 100. Here, the sound outputting apparatus 1 may be an electronic device having a speaker such as a home theater system (HTS), a sound bar, a television, a digital TV, a radio, a personal computer, a laptop computer, etc.

The main body 2 may form an outer shape of the sound outputting apparatus 1, and may accommodate the plurality of loudspeakers 100. FIG. 1 shows that the main body 2 includes only two loudspeakers. However, embodiments are not limited thereto and the main body 2 may be implemented to include one loudspeaker or three or more loudspeakers. In addition, the main body may include two loudspeakers and a separate woofer speaker.

In detail, as shown in FIG. 1, the main body 2 may have a bar shape. In addition, the plurality of loudspeakers 100 may be arranged in the main body 2.

Accordingly, the sound outputting apparatus 1 may emit sound waves generated from the loudspeaker 100 toward an interior wall surface and a ceiling of a room in a predetermined direction, thereby improving directivity and spatial image of the sound outputting apparatus 1.

However, an outer shape of the main body 2 is not limited to the bar shape, and the outer shape may be variously modified into various shapes as needed according to embodiments. In addition, the plurality of loudspeakers 100 accommodated in the main body 2 may be variously arranged in the main body 2 to improve the directivity toward the wall surface and the ceiling.

The plurality of loudspeakers 100 may generate sound waves and output sound waves generated in the predetermined direction, respectively. In detail, a user may be positioned in a direction facing a front surface 1XY of the sound outputting apparatus 1 or the main body 2, and the sound outputting apparatus 1 may emit the generated sound waves toward a diagonal direction of one side surface 1XX of the main body 2 and a top surface 1XZ of the main body 2. The sound outputting apparatus 1 may emit the sound waves in the predetermined direction, thereby providing the generated sound waves to the user positioned spaced apart from the sound outputting apparatus 1 in the direction facing the front surface 1XY of the sound outputting apparatus 1.

The plurality of loudspeakers 100 may each output different sound waves from each other or the same sound waves as each other. The specific structure and operation of this loudspeaker are described below with reference to FIGS. 3 to 6.

Figure 2:
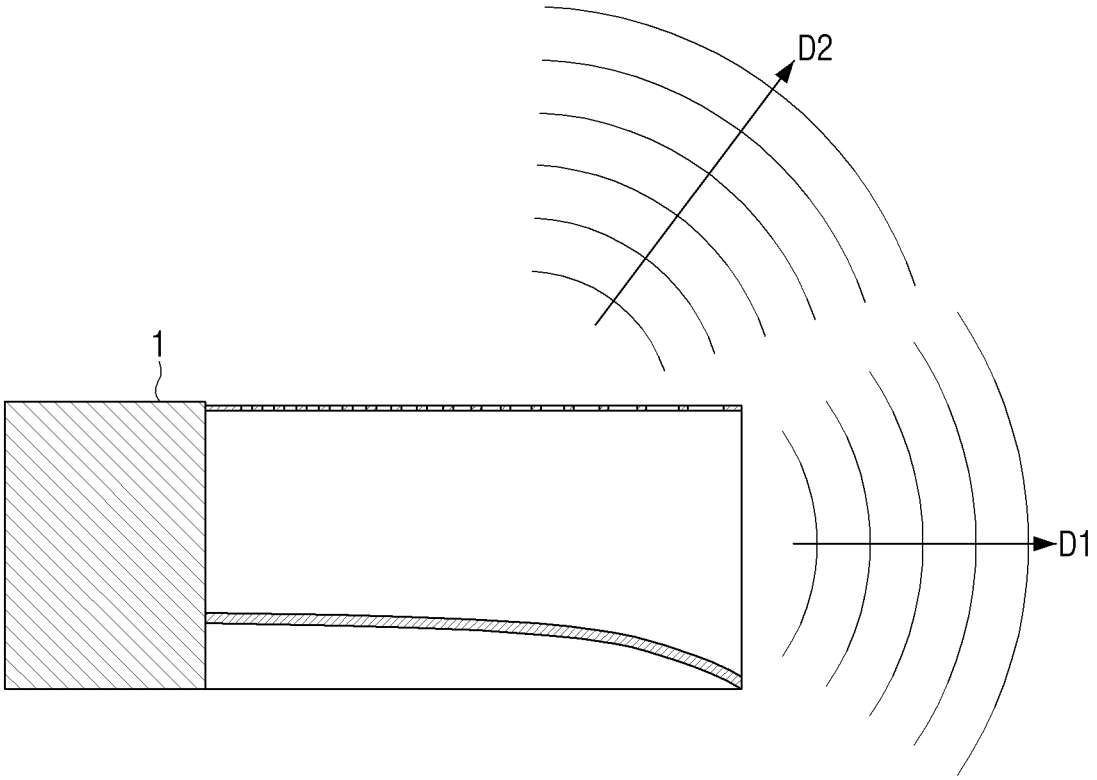
FIG. 2 is a view of directivity of sound waves according to an embodiment.

FIG. 2 is a view of directivity of sound waves according to an embodiment.

In general, a horn speaker may emit high-directional sound waves by attaching a tube with a trumpet structure or a sound structure to a vibration member or a speaker unit, which has an omni-directional feature. The horn speaker may emit the sound waves toward the side direction rather than the front direction facing the direction in which the user is positioned.

The sound outputting apparatus 1 according to embodiments may emit the sound waves not only in the sound-wave emission direction D1 (i.e., the side direction) of the horn speaker, but also in the diagonal direction D2 upward from the emission direction. Therefore, the sound outputting apparatus 1 may provide a richer spatial image than the general horn speaker. The sound outputting apparatus 1 may indirectly transmit the sound waves to the user, thereby allowing the user to have enhanced spatial image of sound waves and an auditory illusion.

Meanwhile, FIGS. 1 and 2 show and describe that the sound outputting apparatus 1 performs only a function of outputting the sound waves. However, embodiments are not limited thereto and the sound outputting apparatus 1 may further include another component such as a display.

In addition, FIG. 1 shows only the mechanical configuration of the sound outputting apparatus 1. However, embodiments are not limited thereto and the sound outputting apparatus 1 may further include a communication apparatus to receive sound source data from the outside and an amplifier to drive a vibration member 110 based on the received sound source data.

Figure 3:
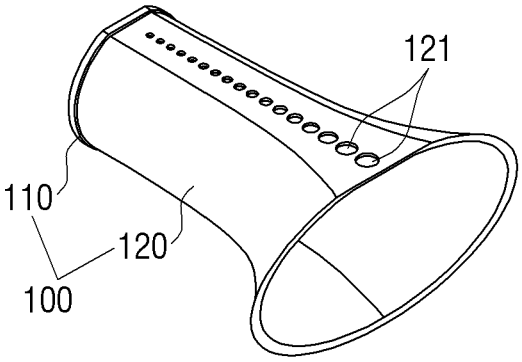
FIG. 3 is a perspective view of a loudspeaker according to an embodiment.
Figure 4:
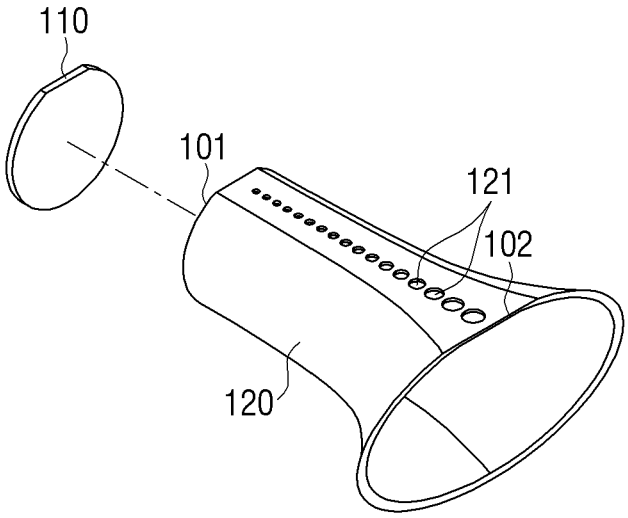
FIG. 4 is an exploded perspective view of the loudspeaker according to an embodiment.
Figure 5:
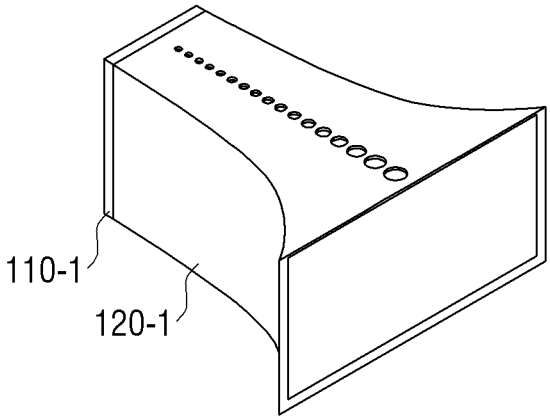
FIG. 5 is a perspective view of a sound guide according to a modified embodiment.
Figure 6:
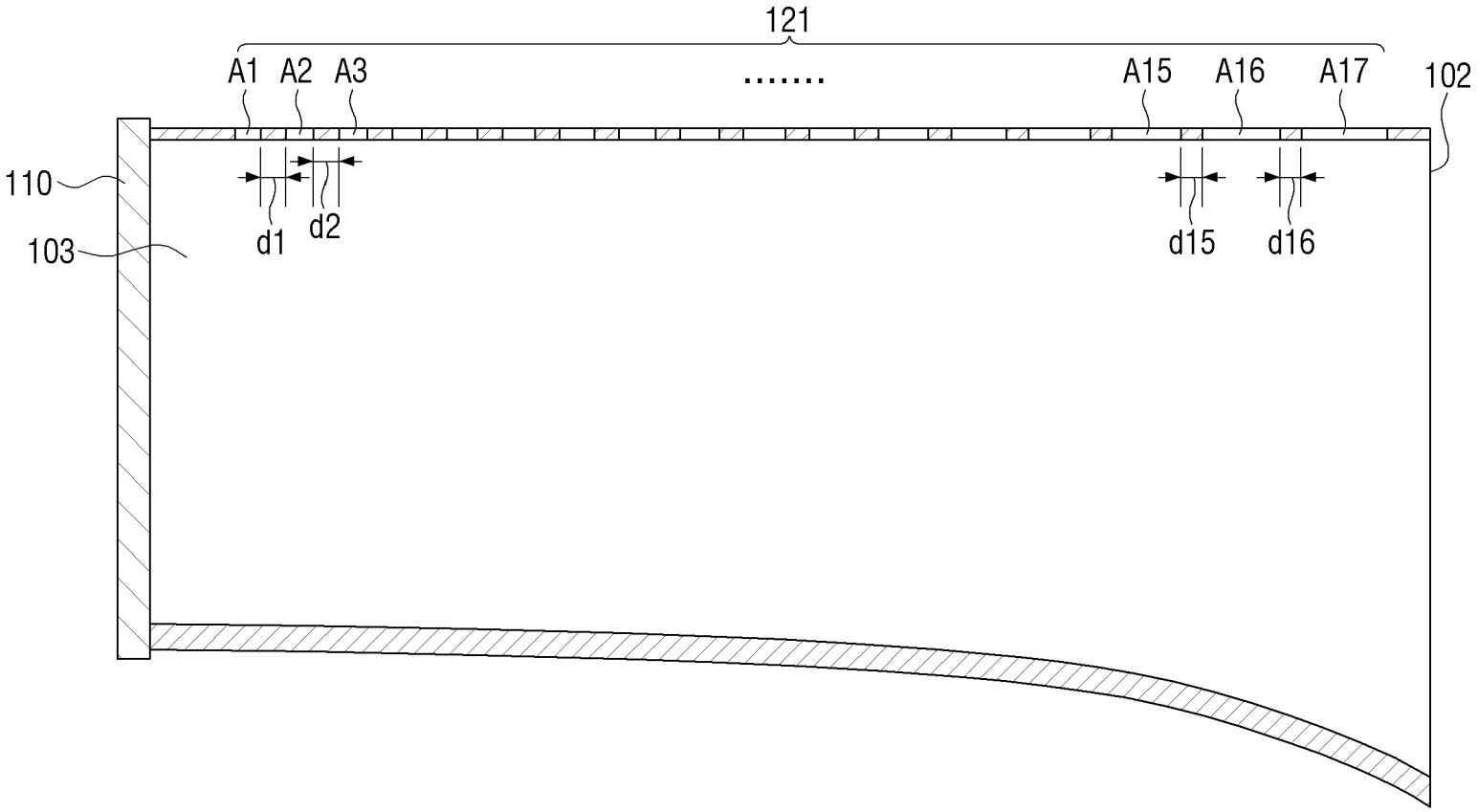
FIG. 6 is a cross-sectional view of the loudspeaker 100 of FIG. 3 according to an embodiment.

FIG. 3 is a perspective view of a loudspeaker 100 according to an embodiment; FIG. 4 is an exploded perspective view of the loudspeaker 100 according to an embodiment; FIG. 5 is a perspective view of a sound guide 120 according to a modified embodiment; and FIG. 6 is a cross-sectional view of the loudspeaker 100 of FIG. 3 according to an embodiment.

Hereinafter, the specific structure of the loudspeaker 100 is described with reference to FIGS. 3 to 6.

According to an embodiment, the loudspeaker 100 is a directional speaker that generates the sound waves in specific directions (e.g., a longitudinal direction a direction that is diagonal to the longitudinal direction), and may include the vibration member 110 to generate the sound waves and the sound guide 120 to serve as an exit for emitting the sound waves.

The vibration member 110 may generate the sound waves. In detail, the vibration member 110 may generate the sound waves by vibrating based on an amplified signal corresponding to sound source content stored in the sound outputting apparatus 1 or sound source content provided from the outside. For example, the vibration member 110 may be implemented by a permanent magnet method, a voice coil method or an electro-dynamic method. Also, the vibration member 110 may be referred to as the speaker unit or the unit.

Referring to FIG. 4, one end 101 of the sound guide 120 is connected to the vibration member 110, and the sound guide 120 may be formed to extend from the one end 101 connected to the vibration member 110. In addition, the sound guide 120 may have another end 102 with an open structure. In addition, the sound guide 120 may have a plurality of openings 121 formed through one surface, the plurality of openings 121 being arranged in a predetermined pattern along a longitudinal direction of the sound guide 120. The plurality of openings 121 are described below with reference to FIG. 5.

Here, the longitudinal direction of the sound guide 120 may refer to a direction away from the vibration member 110. For example, the longitudinal direction may refer to the direction from one end connected to the vibration member 110 to the other end having the open structure. For example, the longitudinal direction may be perpendicular to the vibration member 110.

Accordingly, the sound guide 120 may transmit the sound waves generated from the vibration member 110 to the outside. In particular, the sound guide 120 may guide the sound waves in two specific directions (e.g., the longitudinal direction and a direction that is diagonal to the longitudinal direction), thereby allowing the sound waves to have directivity toward the specific directions described above.

In addition, as shown in FIG. 3, an inner cross-sectional area of the sound guide 120 may increase as distance from the vibration member 110 increases along the longitudinal direction of the sound guide 120. That is, the one end 101 of the sound guide 120 may have the smallest inner cross-sectional area among the cross-sectional areas of the sound guide 120, and the other end 102 of the sound guide 120 may have the largest inner cross-sectional area among the cross-sectional areas of the sound guide 120.

In addition, the inner cross-sectional area of the sound guide 120 may be continuously increased as distance from the vibration member 110 increases. Alternatively, the inner cross-section of the sound guide 120 may have a constant cross-sectional area from the one end 101 of the sound guide 120 to a position away from the vibration member 110 by a predetermined distance, and may have a variable cross-sectional area that increases as distance from the vibration member 110 increases from the position to the other end 102 of the sound guide 120. In this manner, the inner cross-sectional area of the sound guide 120 may have variously formed.

In addition, a cross-section of the sound guide 120 may be fixed to a specific shape, such as a circular shape, an elliptical shape, a curved shape and a polygonal shape. Alternatively, the cross-section of sound guide 120 may have a shape in which the cross-sectional shape and the cross-sectional area are continuously changed for each position of the cross-section as the sound guide becomes farther away from the vibration member 110.

In particular, as shown in FIG. 5, a cross-section of a sound guide 120-1 may have a polygonal shape. In detail, the cross section of the sound guide 120-1 may have a rectangular shape from one end of the cross-section of the sound guide connected to a vibration member 110-1 to the other end having the open structure. In addition, an inner cross-section of the sound guide 120-1 may be gradually increased as distance from the vibration member 110-1 increases.

However, these shapes are only examples, and embodiments are not limited thereto. The one end of the sound guide 120 may be implemented in a circular surface, and the other end of the sound guide 120 may have a square surface, or vice versa. That is, the cross-section of the sound guide 120 may have at least one of a circular shape, an elliptical shape or a polygonal shape, and may be formed in the special pipe shape in which the cross-section of the sound guide 120 is continuously changed based on a position of the cross-section formed in such a shape.

The loudspeaker 100 according to a modified embodiment may emit the sound waves not only in the sound-wave emission direction (i.e., the side direction) of the general horn speaker, but also in the diagonal direction upward from the emission direction, thereby providing the rich spatial image. In addition, the cross-section of the sound guide 120-1 may have the square shape, and therefore the sound guide may be easily included in the main body 2 in case of its production and its production cost may also be saved than a case in which the cross-section of the sound guide 120 has a circular shape.

In addition, as shown in FIG. 6, the sound guide 120 may include a sound guide space 103 connecting with the plurality of openings 121.

The sound guide 120 may have a curved inner surface, thereby forming the sound guide space 103 therein. The sound guide space 103 may be formed as an empty area to serve as a passage through which the sound waves generated from the vibration member 110 connected to the one end of sound guide 120 are emitted to the plurality of openings 121 and the other end 102 of the sound guide 120.

The sound guide 120 may be integrally formed by injection molding. Accordingly, the sound guide 120 may be produced without a separate assembly process, thereby reducing its production time and cost. However, embodiments are not limited to the sound guide 120 being integrally formed. The sound guide 120 may be formed by using a structure-coupling method in which an upper portion and a lower portion are coupled to each other, and may be formed by various coupling method and structure.

In addition, as the length of the sound guide 120 on which the plurality of openings 121 are formed is longer, the directivity toward an upward direction from the sound guide 120, i.e., toward the ceiling may be reduced. Therefore, the length of the sound guide 120 may be designed and implemented in consideration of the directivity of the loudspeaker 100.

Hereinafter, a specific structure of the plurality of openings 121 is described with reference to FIGS. 3 and 6.

As shown in FIG. 6, the plurality of openings 121 may be arranged on the one surface of the sound guide 120 in a predetermined pattern along the longitudinal direction of the sound guide 120. Also, the plurality of openings 121 may connect with the sound guide space 103.

Each of the plurality of openings 121 may have a size determined based on its position or its distance from the vibration member 110. Methods for determining the size of each of the plurality of openings 121 may be changed depending on the embodiments.

For example, as shown in FIG. 6, a diameter of the plurality of openings 121 may increase as distance from the vibration member 110 increases along the longitudinal direction of the sound guide 120. For example, an opening A17, disposed farthest from the vibration member 110 among the plurality of openings 121, may have the largest diameter. In addition, an opening A1, disposed closest to the vibration member 110 among the plurality of openings 121, may have the smallest diameter.

The relationship between the diameters of the plurality of openings 121 may be designed to an optimal value through repeated experiments.

In addition, a combined total surface area of the plurality of openings 121 increases, sensitivity of the sound waves may increase. However, the larger combined total surface area of the plurality of openings 121 decreases directivity of the sound waves. Therefore, the size of the plurality of openings 121 may be designed and implemented in consideration of the sensitivity and directivity of the loudspeaker 100.

A fabric material may be provided in each of plurality of openings 121 to serve as a sound resistance. The fabric material may be used to fine-tune a feature of the sound waves emitted from each opening. For example, an opening closer to the vibration member 110 may have a thicker fabric material, and an opening farther away from the vibration member 110 may have a thinner fabric material.

The above description describes that the fabric material has a thickness that changes based on a distance of the opening from the vibration member. However, embodiments are not limited thereto and a thickness of the fabric material may change based on the diameter of the opening.

In particular, the opening having a small thickness (e.g. opening A1 close to the vibration member) may be covered by a thick fabric material, thereby serving as a 'sound-wave feature regulator' for improving emission directivity of a sound wave component in a low frequency.

In addition, the fabric material may be various materials including a jersey material.

Meanwhile, the small openings among the plurality of openings 121 may have an influence on emission of the sound waves in the low frequency band, and the large openings among the plurality of openings 121 may have an influence on emission of the sound waves in a high frequency band.

Therefore, the loudspeaker 100 may have the openings of various sizes, not of the same size, thereby improving its overall directivity feature of the sound waves from the low frequency band to the high frequency band.

In addition, the plurality of openings 121 may be spaced apart from each other by a predetermined distance in the longitudinal direction of the sound guide 120. Here, the distance may refer to each interval between the openings among the plurality of openings 121. A first distance d1 to the sixteenth distance d16 shown in FIG. 6 may each refer to the interval between the openings.

In addition, the distance between the openings disposed close to the vibration member 110 on the sound guide 120 may be the same as the distance between the openings disposed far away from the vibration member 110. In detail, as shown in FIG. 6, the first distance d1, a second distance d2, a fifteenth distance d15, and the sixteenth distance d16 may be the same distance as each other.

According to another embodiment, the plurality of openings 121 that are farther away from the vibration member 110 may be spaced apart from each other by a smaller distance than those closer to the vibration member 110. Alternatively, the plurality of openings 121 that are farther away from the vibration member 110 may be spaced apart from each other by a greater distance than those closer to the vibration member 110.

FIGS. 7 to 11 are top views each showing a sound guide 120 according to modified embodiments.

The plurality of openings 121*a* to 121*d* and one slit 121*e* shown in FIGS. 7 to 11 may be formed through one surface of sound guides 120*a* to 120*e*, respectively, as those described above and have the same structure in which the plurality of openings connect with the sound guide space 103. Therefore, redundant description thereof is omitted.

Figure 7:
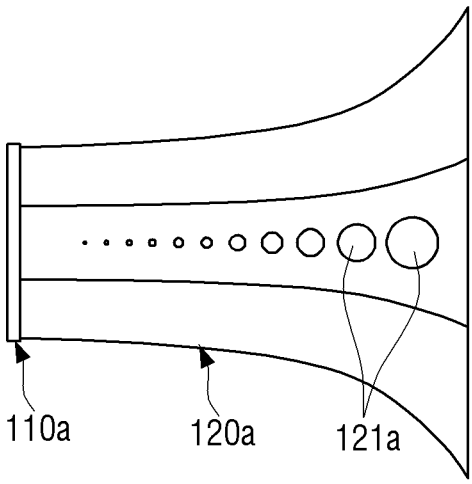
FIG. 7 is a top view of a sound guide according to a modified embodiment.

As shown in FIG. 7, the sound guide 120*a* may include the plurality of openings 121*a* of different sizes. Size of the plurality of openings 121*a* may increase as distance from a vibration member 110*a* increases. The size of plurality of openings 121*a* included in the sound guide 120*a* may increase based on a linear ratio as distance from the vibration member 110*a* increases along a longitudinal direction of the sound guide 120*a*. For example, a size ratio of an opening disposed closest to the vibration member 110*a* and the opening disposed subsequently thereto in the longitudinal direction may be the same as that of two openings disposed farthest away from the vibration member 110*a*. That is, the plurality of openings 121*a* may each have an increased size by a predetermined ratio along the longitudinal direction.

Figure 8:
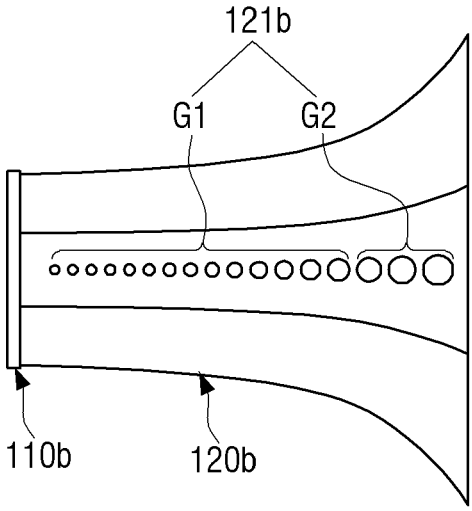
FIG. 8 is a top view of a sound guide according to a modified embodiment.

As shown in FIG. 8, the sound guide 120*b* may include the plurality of openings 121*b* having different sizes. The plurality of openings 121*b* may increase in size based on a non-linear ratio as distance from a vibration member 110*b* along a longitudinal direction of the sound guide 120*b* increases. In detail, some of the plurality of openings 121*b* may have the same size diameter. For example, the plurality of openings 121*b* may be implemented to include: a plurality of first openings G1 each having a diameter that increases by the predetermined ratio as distance from the vibration member 110*b* along the longitudinal direction of the sound guide 120*b* increases, and a plurality of second openings G2 arranged subsequently to the plurality of first openings G1. One or more of the plurality of second openings G2 may have the same diameter as one or more of the plurality of first openings G1.

Alternatively, according to another embodiment, diameters of the plurality of first openings G1 may increase as distance from the vibration member 110*b* increases, but the diameters of the plurality of first openings G1 may increase in different ratios. That is, diameters of the plurality of first openings G1 may increase based on a non-linear ratio.

Figure 9:
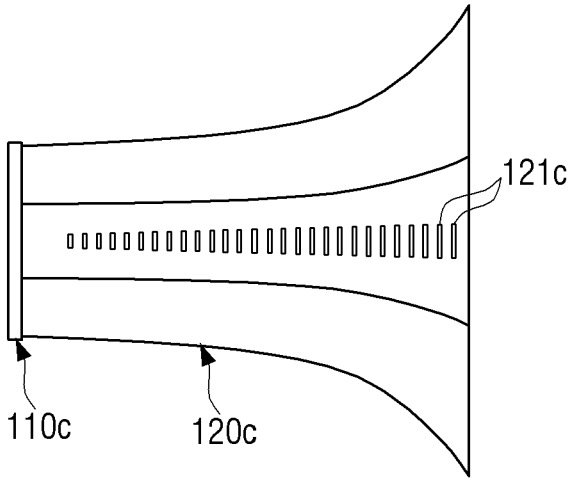
FIG. 9 is a top view of a sound guide according to a modified embodiment.
Figure 10:
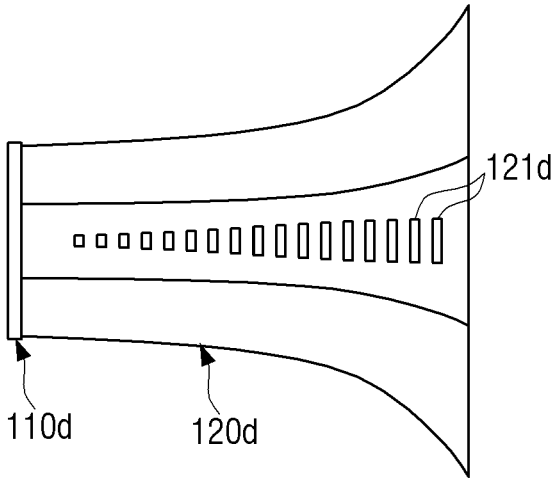
FIG. 10 is a top view of a sound guide according to a modified embodiment of the disclosure.

FIGS. 9 and 10 are top views each showing a sound guide according to modified embodiments. As shown in the drawings, the plurality of openings may each be formed as symmetrical rectangles with variously modified aspect ratios.

As shown in FIG. 9, the sound guide 120*c* may include the plurality of openings 121*c* having different sizes. The plurality of openings 121*c* included in the sound guide 120*c* may be formed in a shape of a polygon such as a rectangle, square or rhombus. For example, the plurality of openings 121*c* may be formed in the rectangular shape. In addition, each of the plurality of openings 121*c* may have the same horizontal length, but may have different vertical lengths. Here, the horizontal length may refer to a longitudinal direction of the sound guide 120*c*.

The plurality of openings 121*c* may have different vertical lengths, and thus have different sizes. In detail, the plurality of openings 121*c* may increase in size based on a non-linear ratio as distance from a vibration member 110*c* increases along the longitudinal direction of the sound guide 120*c*. In detail, some of the plurality of openings 121*c* may have the same size diameter to each other. For example, the plurality of openings 121*c* may be implemented to include a plurality of first openings each having a diameter that increases based on a predetermined ratio as distance from the vibration member 110*c* increases along the longitudinal direction of the sound guide 120*c*, and a plurality of second openings arranged subsequently to the plurality of first openings that have the same diameters as the plurality of first openings, respectively.

As shown in FIG. 10, the sound guide 120*d* may include the plurality of openings 121*d* having different sizes. FIG. 10 shows the plurality of openings 121*d* formed in the shape of the symmetrical rectangle, but the number of the plurality of openings 121*d* may be less than that of the plurality of openings 121*c* shown in FIG. 9. That is, a different number of the plurality of openings may be implemented based on each implemented shape of the openings.

Figure 11:
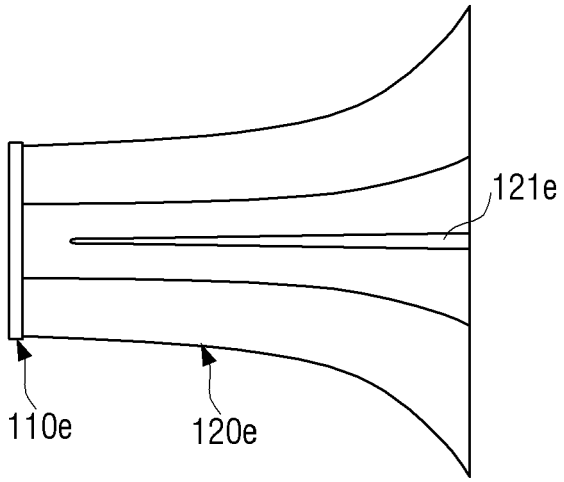
FIG. 11 is a top view of a sound guide according to a modified embodiment.

FIG. 11 is a top view showing a sound guide 120*e* according to another embodiment. As shown in FIG. 11, the sound guide 120*e* may have one slit 121*e* formed through its surface, instead of the plurality of openings 121. The one slit 121*e* may have an increased width (perpendicular to the longitudinal direction) as distance from a vibration member 110*e* increases. The loudspeaker 100 may improve the directivity toward the diagonal in the longitudinal direction of the sound guide 120*e* by using the one slit 121*e* included in the sound guide 120*e*. In addition, a direction of the sound waves may depend on the width or length of the one slit 121*e* included in the sound guide 120*e*. Therefore, the one slit 121*e* implemented to have a different shape may improve the directivity of the sound waves toward the specific direction that is diagonal to the longitudinal direction. In addition, the sound guide 120 may be implemented to include a plurality of slits.

For convenience of description, FIGS. 7 to 10 show that the plurality of openings 121*a* to 121*d* are formed in a single shape. However, embodiments are not limited thereto, and each of the plurality of openings may be implemented to have at least one of a circular shape, an elliptical shape, a rectangular shape and a rhombus shape. That is, the openings having different shapes may be arranged continuously on the sound guide 120. For example, one of the plurality of openings 121*a* of FIG. 7 may be disposed on the sound guide 120, and one of the plurality of openings 121*c* in FIG. 9 may be disposed subsequently to the one of the plurality of openings 121*a* in FIG. 7.

In addition, FIGS. 1 to 10 show that the plurality of openings 121 are arranged in a row pattern. However, the plurality of openings 121 are not limited to this pattern, and may be arranged on a sound guide 120 in a curved pattern. For example, the plurality of openings 121 may be formed through the sound guide 120 along a circumference of the sound guide 120. Alternatively, the plurality of openings 121 may be arranged in a sinusoidal wave pattern in the longitudinal direction of the sound guide 120. Alternatively, the plurality of openings 121 may be arranged in a zigzag pattern.

As such, the plurality of openings 121 may be distributed and arranged in a predetermined pattern, thereby improving the directivity of the sound waves toward the specific directions, in particular the longitudinal direction and the direction diagonal to the longitudinal direction of the sound guide 120.

Figure 12:
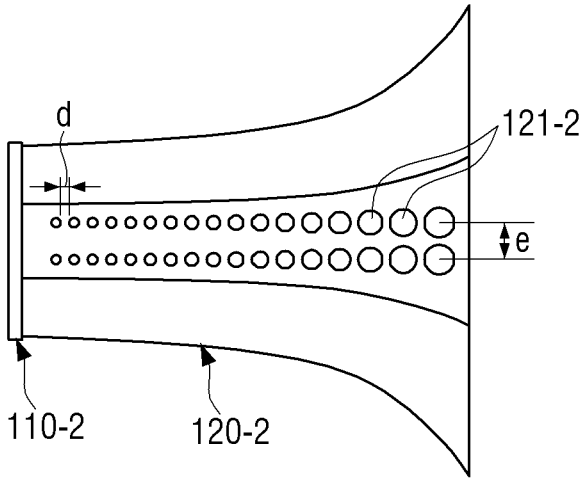
FIG. 12 is a top view of a sound guide according to a modified embodiment.

FIG. 12 is a top view of a sound guide 120-2 according to another modified embodiment.

A plurality of openings 121-2 may be formed through one surface of the sound guide 120-2, as those described above and have the same structure in which the plurality of openings connect with the sound guide space 103. Therefore, redundant description thereof is omitted.

As shown in FIG. 12, the plurality of openings 121-2 may be arranged in each of a plurality of rows along a longitudinal direction of the sound guide 120-2. In addition, the plurality of openings 121-2 included in each of the plurality of rows may have the same distance therebetween. That is, the openings included in the same row may have the same distance between each other.

In addition, the plurality of openings 121-2 respectively included in rows different from each other may have a predetermined distance 'e' therebetween. Here, the distance between the plurality of openings respectively included in the rows different from each other may refer to a distance between centers of the respective openings. For example, as shown in FIG. 12, the sound guide 120-2 may include the plurality of openings 121-2 arranged in a plurality of rows along the longitudinal direction of the sound guide 120-2. As shown in FIG. 12, the plurality of such rows may be arranged to be parallel to each other. For example, as distance from vibration member 110-2 increases, the distance between centers of the respective openings may decrease.

The plurality of openings 121-2 may be implemented to be arranged in the zigzag pattern in the longitudinal direction of the sound guide 120-2.

In addition, the plurality of rows in which the plurality openings are arranged along the longitudinal direction of the sound guide may have the predetermined distance therebetween and the plurality openings may thus be freely arranged in, such as a plurality of straight rows or curved rows. In case that the cross-section of the sound guide 120-2 has a circular shape, the plurality of openings 121-2 may be arranged in a plurality of rows along a circumference of the sound guide 120-2.

Here, the plurality of rows may have not only the predetermined distance, but also a different distance therebetween as needed.

Accordingly, the increased plurality of openings 121-2 may enhance sensitivity of a sound pressure level, and the pattern in which the plurality of openings are arranged in the plurality of rows may also improve the directivity toward the longitudinal direction and the diagonal in the longitudinal direction of the sound guide.

Although embodiments have been individually described hereinabove, the configurations and operations of the embodiments may be combined.

Although embodiments of the disclosure have been illustrated and described hereinabove, the disclosure is not limited to the abovementioned specific embodiments, but may be variously modified by those skilled in the art to which the disclosure pertains without departing from the gist of the disclosure as disclosed in the accompanying claims. These modifications should also be understood to fall within the scope and spirit of the disclosure.

What is claimed is:

1. A loudspeaker comprising:

a vibration member configured to generate sound waves; and a sound guide having a first end connected to the vibration member, a second end having an open structure, a first surface between the first end and the second end, and a plurality of openings formed through the first surface along a longitudinal direction of the sound guide, wherein the plurality of openings increase in size as distance from the vibration member increases, wherein the sound guide has a second surface, opposite the first surface, between the first end and the second end, wherein the first surface is planar, and wherein distance between the first surface and the second surface increases as distance from the vibration member increases along the longitudinal direction.

2. The loudspeaker as claimed in claim 1, wherein a cross-section of the sound guide has one from among a circular shape, an elliptical shape and a polygonal shape.

3. The loudspeaker as claimed in claim 1, wherein a cross-sectional area of the sound guide increases as distance from the vibration member increases along the longitudinal direction.

4. The loudspeaker as claimed in claim 1, wherein size of the plurality of openings increases based on a non-linear ratio as distance from the vibration member increases along the longitudinal direction.

5. The loudspeaker as claimed in claim 1, wherein the plurality of openings comprise:

a plurality of first openings that increase in size based on a predetermined ratio as distance from the vibration member increases along the longitudinal direction; and a plurality of second openings arranged subsequently to the plurality of first openings and a size corresponding to one of the plurality of first openings.

6. The loudspeaker as claimed in claim 1, wherein the plurality of openings are arranged in each of a plurality of rows along the longitudinal direction.

7. The loudspeaker as claimed in claim 1, wherein the plurality of openings each have one from among a circular shape, an elliptical shape, a rectangular shape, a square shape and a rhombus shape.

8. The loudspeaker as claimed in claim 1, wherein the plurality of openings are spaced apart from each other by a predetermined interval.

9. The loudspeaker as claimed in claim 1, wherein an interval between the plurality of openings decreases as distance from the vibration member increases.

10. A sound outputting apparatus comprising:

a main body; and a loudspeaker accommodated in the main body, wherein the loudspeaker comprises:

a vibration member configured to generate sound waves; and a sound guide having a first end connected to the vibration member, a second end having an open structure, a first surface between the first end and the second end, and a plurality of openings formed through the first surface along a longitudinal direction of the sound guide, wherein the plurality of openings increase in size as distance from the vibration member increases, wherein the sound guide has a second surface, opposite the first surface, between the first end and the second end, wherein the first surface is planar, and wherein distance between the first surface and the second surface increases as distance from the vibration member increases along the longitudinal direction.

11. The sound outputting apparatus as claimed in claim 10, wherein a cross-section of the sound guide has one from among a circular shape, an elliptical shape and a polygonal shape.

12. The sound outputting apparatus as claimed in claim 10, wherein a cross-sectional area of the sound guide increases as distance from the vibration member increases along the longitudinal direction.

13. The sound outputting apparatus as claimed in claim 10, wherein size of the plurality of openings increases based on a non-linear ratio as distance from the vibration member increases along the longitudinal direction.

14. The sound outputting apparatus as claimed in claim 10, wherein the plurality of openings comprise:

a plurality of first openings that increase in size based on a predetermined ratio as distance from the vibration member increases along the longitudinal direction; and a plurality of second openings arranged subsequently to the plurality of first openings and a size corresponding to one of the plurality of first openings.

15. The sound outputting apparatus as claimed in claim 10, wherein the plurality of openings are arranged in each of a plurality of rows along the longitudinal direction.

16. The sound outputting apparatus as claimed in claim 10, wherein the plurality of openings each have one from among a circular shape, an elliptical shape, a rectangular shape, a square shape and a rhombus shape.

17. The sound outputting apparatus as claimed in claim 10, wherein the plurality of openings are spaced apart from each other by a predetermined interval.

18. The sound outputting apparatus as claimed in claim 10, wherein an interval between the plurality of openings decreases as distance from the vibration member increases.

19. The sound outputting apparatus as claimed in claim 10, wherein the main body has a bar shape, and wherein the loudspeaker is accommodated in a first end of the main body and another loudspeaker is accommodated in a second end of the main body.

20. A loudspeaker comprising:

a vibration member configured to generate sound waves; and a sound guide having a first end connected to the vibration member, a second end having an open structure, a first surface between the first end and the second end, and a first opening formed through the first surface along a longitudinal direction of the sound guide, wherein a width of the first opening increases as distance from the vibration member increases, wherein the sound guide has a second surface, opposite the first surface, between the first end and the second end, wherein the first surface is planar, and wherein distance between the first surface and the second surface increases as distance from the vibration member increases along the longitudinal direction.

21. A loudspeaker comprising:

a sound guide having a first end, a second end having an open structure, a first surface between the first end and the second end, and a plurality of openings formed through the first surface along a longitudinal direction of the sound guide, wherein the plurality of openings increase in size as distance from the first end increases, wherein the sound guide has a second surface, opposite the first surface, between the first end and the second end, wherein the first surface is planar, and wherein distance between the first surface and the second surface increases as distance from the vibration member increases along the longitudinal direction.

* * * * *